US009555621B2

(12) United States Patent
Jeanmaire et al.

(10) Patent No.: US 9,555,621 B2
(45) Date of Patent: Jan. 31, 2017

(54) CONTINUOUS PRINTHEAD DROP DEFLECTOR SYSTEM

(71) Applicant: Eastman Kodak Company, Rochester, NY (US)

(72) Inventors: David Louis Jeanmaire, Brockport, NY (US); Scott Bernard Mahon, Rochester, NY (US)

( * ) Notice: Subject to any disclaimer, the term of this patent is extended or adjusted under 35 U.S.C. 154(b) by 162 days.

(21) Appl. No.: 14/631,943

(22) Filed: Feb. 26, 2015

(65) Prior Publication Data

US 2016/0250845 A1 Sep. 1, 2016

(51) Int. Cl.
*B41J 2/09* (2006.01)
*B41J 2/03* (2006.01)

(52) U.S. Cl.
CPC ..... *B41J 2/03* (2013.01)

(58) Field of Classification Search
CPC ... B41J 12/03; B41J 2002/02; B41J 2002/022; B41J 2002/031; B41J 2002/033
See application file for complete search history.

(56) References Cited

U.S. PATENT DOCUMENTS 7,735,980 B2 * 6/2010 Xu ..... B41J 2/02 347/77
8,091,991 B2 1/2012 Hanchak et al.
8,596,750 B2 12/2013 Yu

* cited by examiner

*Primary Examiner* — Juanita D Jackson
(74) *Attorney, Agent, or Firm* — Peyton C. Watkins

(57) ABSTRACT

A continuous printhead drop deflector system includes a gas flow duct including a wall, the wall including a porous member having pores through which liquid can flow and a liquid flow channel, the flow channel being separated from the air flow duct by the porous member, the flow channel includes; a first port for extracting liquid from a first portion of the liquid flow channel; a second port for supplying liquid to a second portion of the liquid flow channel; one or more paths in the liquid channel permitting fluid to flow from the second portion to the first portion; wherein liquid, supplied through the second port to the second portion of the liquid channel and through the one or more paths to the first portion of the liquid channel, contacts and wicks into the porous member before being extracted through the first port.

8 Claims, 10 Drawing Sheets

CONTINUOUS PRINTHEAD DROP DEFLECTOR SYSTEM

FIELD OF THE INVENTION

This invention relates generally to the field of digitally controlled printing devices, and in particular to continuous inkjet systems in which a liquid stream breaks into droplets that are deflected by a gas flow.

BACKGROUND OF THE INVENTION

Continuous stream inkjet printing uses a pressurized ink source which produces a continuous stream of ink droplets. Stimulation devices, such as heaters positioned around the nozzle, stimulate the stream to break up into drops with either relatively large volumes or relatively small volumes. These drops are then directed by one of several means, including electrostatic deflection or gas flow deflection. Printheads utilizing gas flow for deflection are known and have been described.

In one form of such printheads, the drop deflecting gas flow is produced at least in part by a gas, typically air, drawn into a negative air duct as a result of vacuum applied to the duct. Drops of a predetermined small volume are deflected more than drops of a predetermined large volume. This allows for the small drops to be deflected into an ink capturing mechanism (catcher, interceptor, gutter, etc.) where they are either recycled or discarded. The large drops are allowed to strike the print medium. Alternatively, the small drops may be allowed to strike the print medium while the larger drops are collected in the ink capturing mechanism.

It has been determined that while small drops are deflected by the lateral airflow more than large drops, not all small drops follow the same trajectory. Some of these drops can be deflected sufficiently by the air flow such that they enter the gas flow duct, causing ink puddles to form. Ink puddles in the air duct can also be formed during startup and shutdown of the printhead caused by ink dripping off the upper wall of the gas flow duct and landing on the lower wall of the gas flow duct. Additionally, ink puddles can be formed due to a crooked jet which causes ink to be directed into the gas flow duct. Ink from the puddles of ink in the gas flow duct can be dragged by the gas flow up into the vacuum source that is attached to the gas flow duct, potentially damaging the vacuum source. If the ink puddles remain close to the entrance to the duct, these puddles can affect the uniformity of the air flow across the width of the jet array. Ink puddles can induce oscillations in the gas flow that can produce a modulation in the print drop trajectories that adversely affect print quality.

Accordingly, a need exists to maintain the cleanliness of the gas flow duct and remove ink puddles formed therein.

SUMMARY OF THE INVENTION

A continuous printhead drop deflector system includes a gas flow duct including a wall, the wall including a porous member having pores through which liquid can flow and a liquid flow channel, the flow channel being separated from the air flow duct by the porous member, the flow channel includes; a first port for extracting liquid from a first portion of the liquid flow channel; a second port for supplying liquid to a second portion of the liquid flow channel; one or more paths in the liquid channel permitting fluid to flow from the second portion to the first portion; wherein liquid, supplied through the second port to the second portion of the liquid channel and through the one or more paths to the first portion of the liquid channel, contacts and wicks into the porous member before being extracted through the first port.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
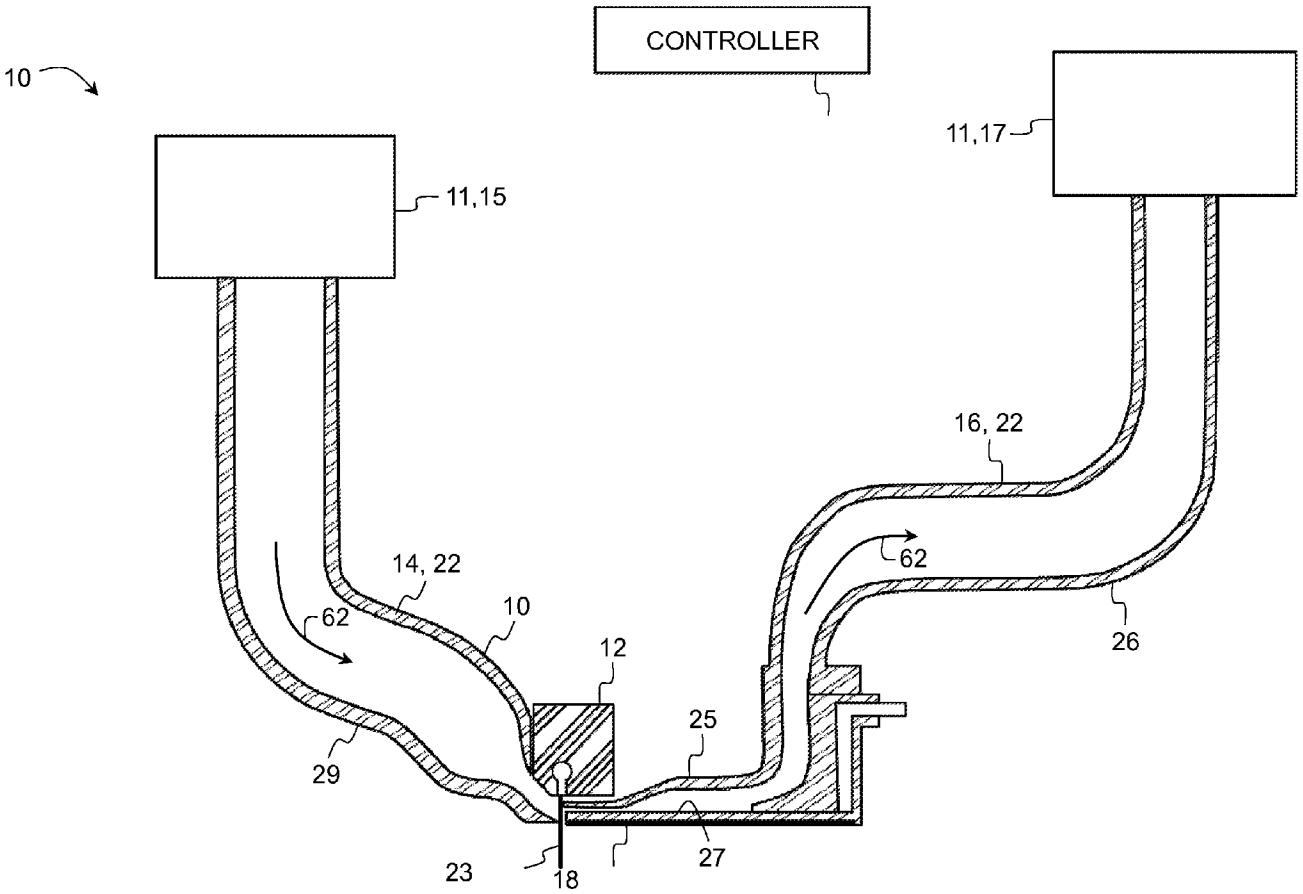
FIG. 1 (PRIOR ART)
FIG. 1 is a schematic cross section illustration of an example embodiment of a continuous inkjet printhead.
Figure 2:
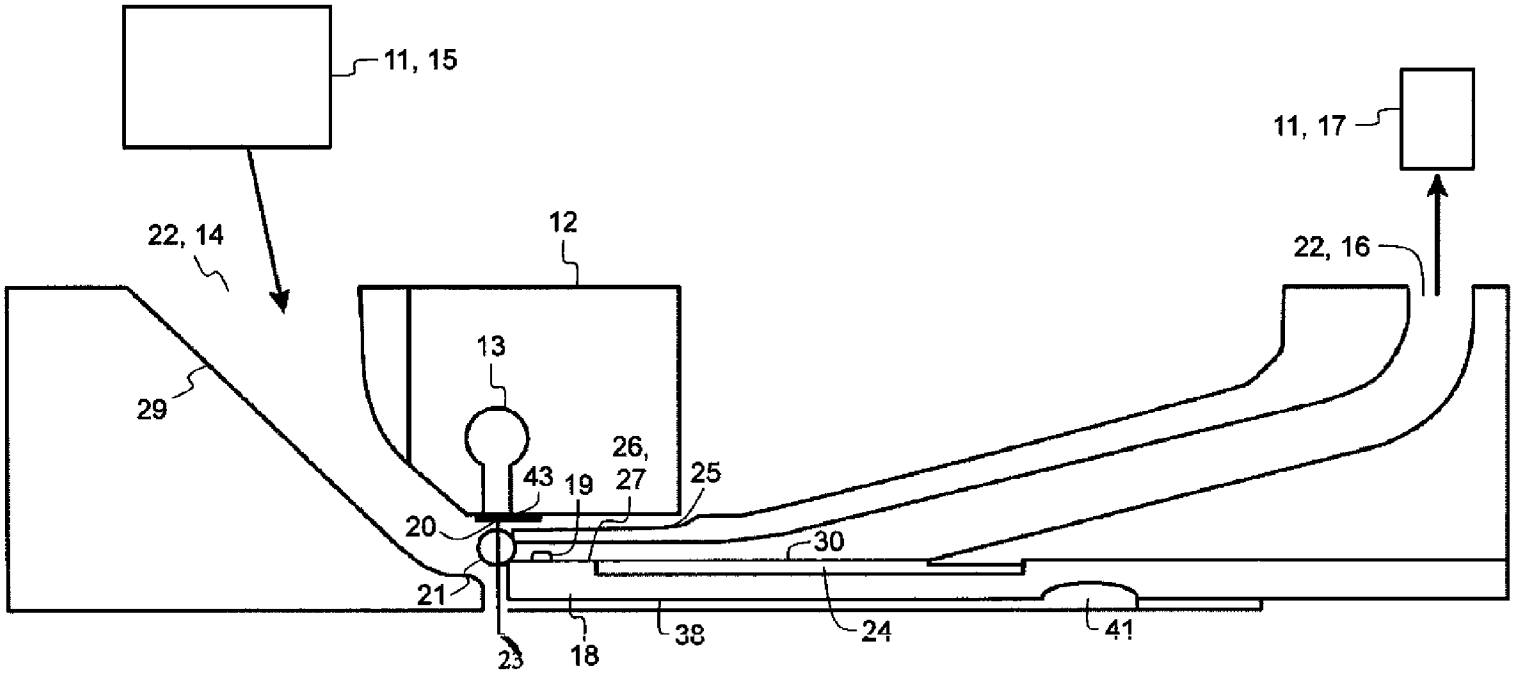
FIG. 2 (PRIOR ART)
FIG. 2 is an enlarged schematic cross section illustration of an example embodiment of a continuous inkjet printhead.

FIGS. 1 and 2 show a gas flow drop deflection continuous inkjet printhead 10. A printing fluid, commonly referred to as ink, is supplied under pressure by a fluid system (shown in FIG. 10) to a jetting module 12. An ink supply channel 13 in the jetting module 12 provides printing fluid to a plurality of nozzles 20. A stimulation device, for example a heater 43, associated with each nozzle 20, is employed to selectively create large and small drops that follow and initial drop trajectory 23. A drop deflection system includes one or more gas flow ducts 22, each gas flow duct 22 having an associated gas flow source 11 to create a gas flow 62. Gas flow duct 22 is a positive gas flow duct 14, when the gas flow source 11 is in the form of a fan or blower 15 that directs a flow of gas 62 into the gas flow duct and produces a positive pressure gas flow in the gas flow duct that is directed across the drop trajectories. Gas flow duct 22 is a negative gas flow duct 16, when the gas flow source 11 is in the form of a vacuum source 17 that draws gas from the gas flow duct and produces a vacuum or negative pressure in the gas flow duct. The gas being drawn into the negative gas flow duct by the negative pressure produces a flow of gas 62 across the drop trajectories 23. The flow of gas across the drop trajectories 23, produced by a positive, a negative, or by both positive and negative gas flow ducts, causes the drops to be deflected from their initial trajectories. The space around the drop trajectories 23 from the plurality of nozzles in which the flow of gas across the drop trajectories 23 produces the deflection of the drops is called the drop deflection zone 21. Gas flow ducts 22 in the region, adjacent to the drop deflection zone 21, have a width (in and out of FIGS. 1-2) that is greater than the length of the nozzle array (also in and out of FIGS. 1-2).

The gas flow ducts 22 are bounded by walls. FIG. 1 shows an upper wall 25 and a lower wall 27 of the negative gas flow duct 16 and the lower wall 29 of the positive gas flow duct 14. In this embodiment, wall 26 is also lower wall 27 of the negative gas flow duct 16, though wall 26 can be any of the walls of the gas flow ducts 22. A portion of the jetting module 12 forms part of the upper wall of the positive gas flow duct 14.

Figure 3:
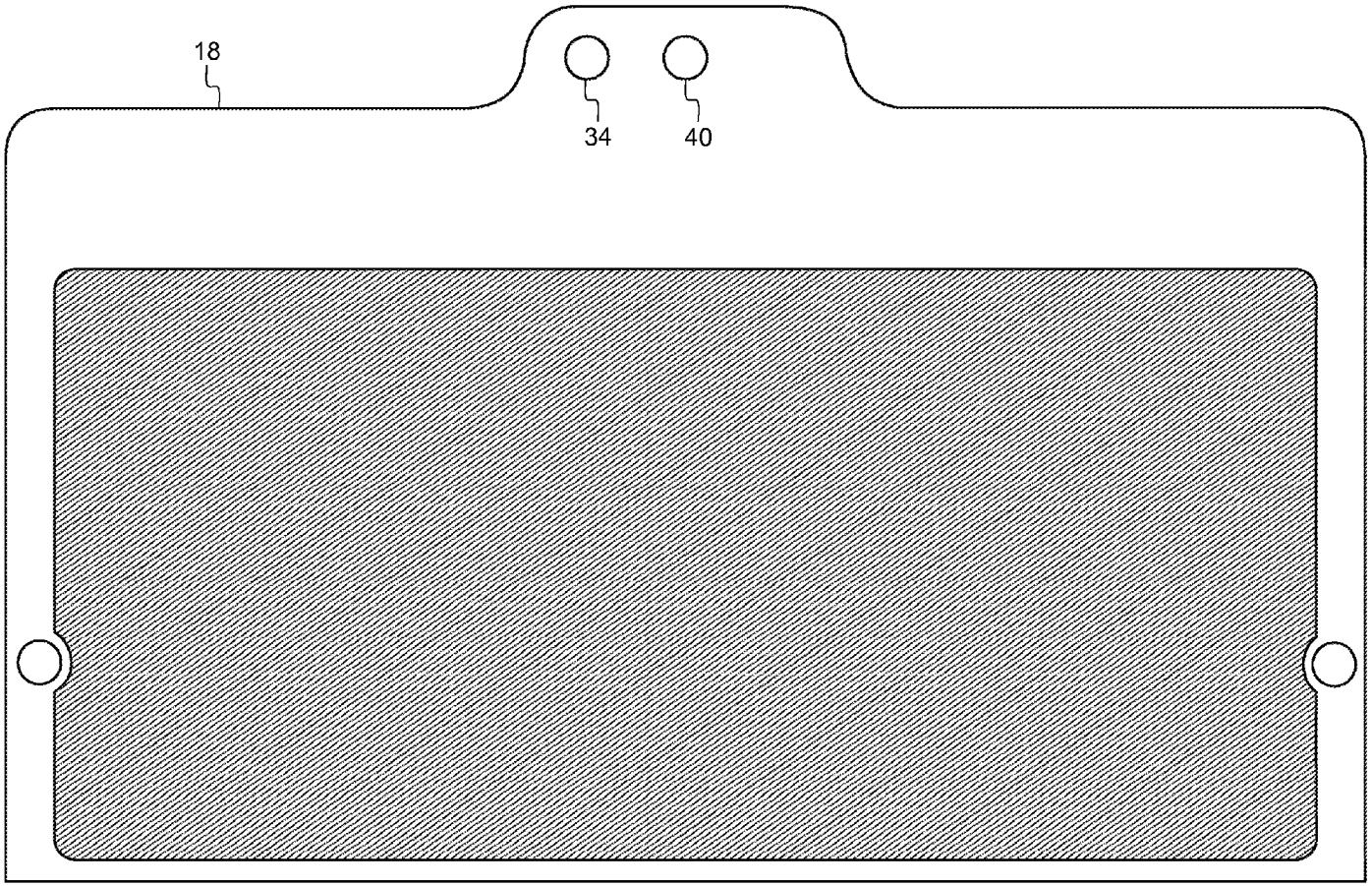
FIG. 3 (PRIOR ART)
FIG. 3 is a top view of a prior art catcher showing a porous member for liquid extraction from the negative air duct.
Figure 10:
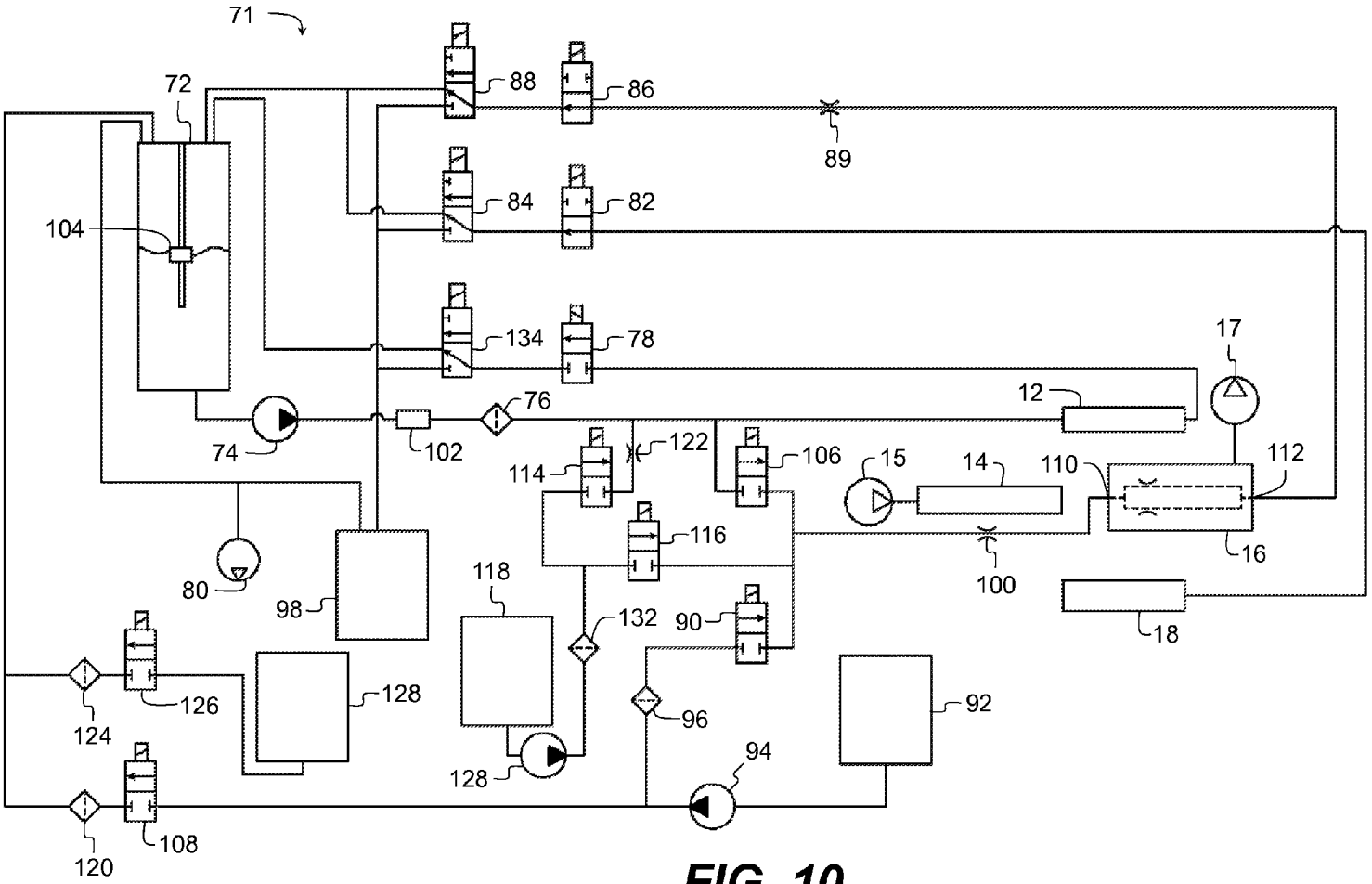
FIG. 10 is a schematic diagram of an example fluid system for use with an embodiment of the present invention.

A catcher 18 is used to intercept the trajectories of the small drops, and while allowing the large drops to strike the print media. The catcher 18 includes catcher flow channel 38 which is in fluid communication with a catcher (second) port 40 shown in FIGS. 3 and 8. Second port 40 is in fluid communication with a vacuum source for removal of ink from the catcher 18. The vacuum source can be included as part of a fluid system of the inkjet printing station (shown in FIG. 10), allowing the printing fluid to be recycled or sent to a waste tank. The fluid system can also include a valve to control the flow of recovered printing fluid to the ink reservoir or waste tank. An exemplary fluid system is illustrated in FIG. 10 and is described later. In this example embodiment, the vacuum source in fluid communication with catcher (second) port 40 is distant from vacuum source 17 which is associated with negative gas flow duct 16.

To remove printing fluid or other debris from the gas flow duct 22, liquid flow channel 24 is formed in a wall 26 of the gas flow duct 22. Typically the liquid flow channel 24 is formed in lower wall 27 of the gas flow duct 22. Liquid flow channel 24 can be located proximate drop deflection zone 21, as is shown in FIG. 2. Alternatively, liquid flow channel 24 can be located farther from the drop deflection zone 21. Typically, the location of liquid flow channel 24 relative to drop deflection zone 21 depends on where gas flow duct 22 collects liquid puddles and debris.

Figure 4:
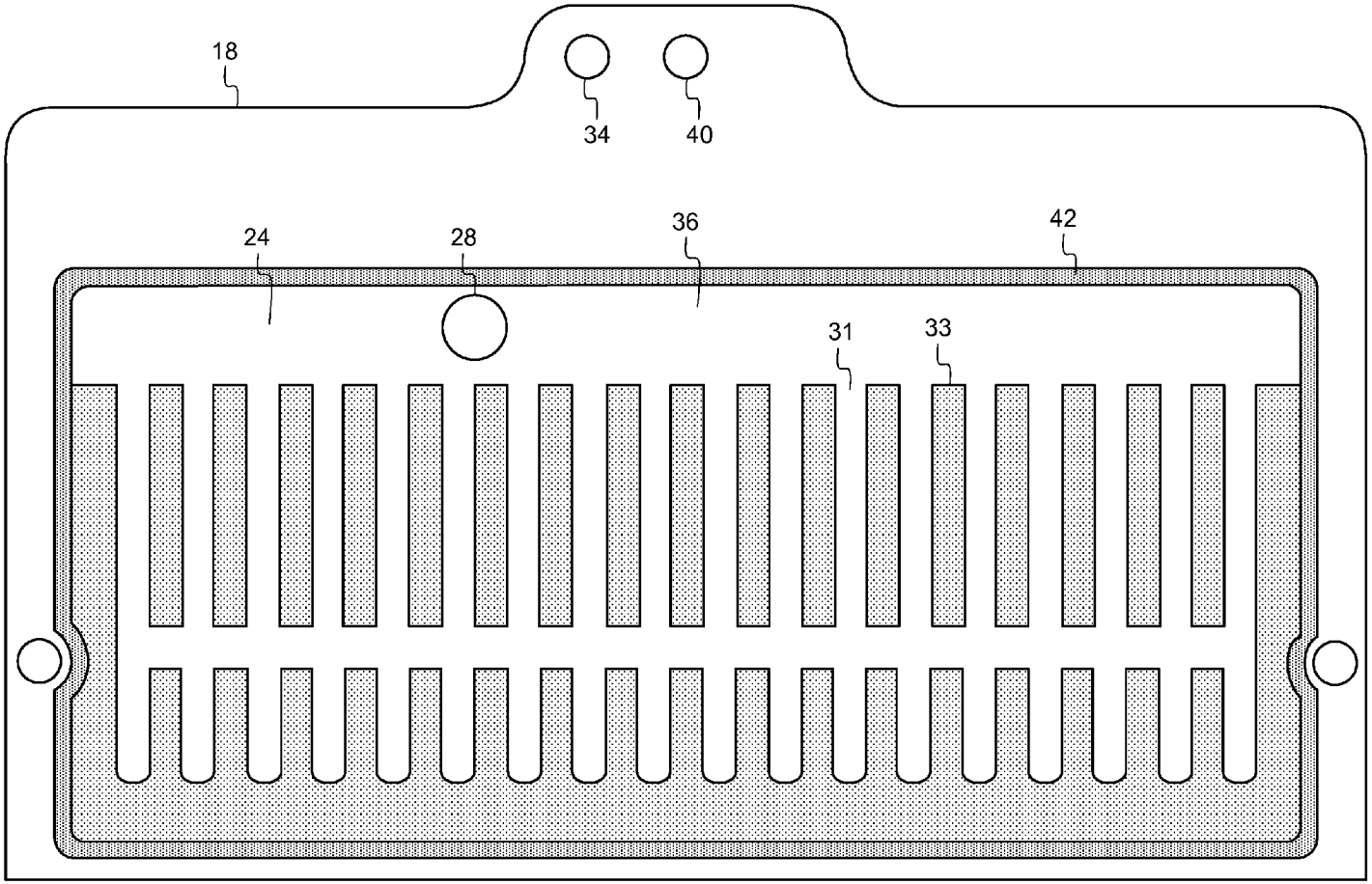
FIG. 4 (PRIOR ART)
FIG. 4 is a top view of a prior art catcher showing the liquid flow channels below the porous member for liquid extraction.

The liquid flow channel 24 is shown from another perspective in FIG. 4. Liquid flow channel 24 is in fluid communication with a liquid flow channel port 34 (a first port). Liquid flow channel port (first port) 34 is in fluid communication with a vacuum source (shown in FIG. 10 for removal of liquid from the liquid flow channel 24. The fluid communication can be provided through tubing that can be attached to fitting 35 that is attached to the first port 34. The vacuum source can be included as part of a fluid system of the inkjet printing station, allowing the liquid removed through the first port 34 to be recycled or sent to a waste tank. Liquid flow channel 24 and port 34 are isolated from catcher flow channel 38 and port 40 which helps to better control liquid flow, gas flow, and/or vacuum levels in liquid flow channel 24 and catcher flow channel 38.

The vacuum source in fluid communication with liquid flow channel port 34 (first port) is a separate vacuum source than the vacuum source 17 associated with negative gas flow duct 16. Additionally, the vacuum source in fluid communication with first port 34 can be separate from the vacuum source in fluid communication with second port 40. Alternatively, the first and second ports 34 and 40 can use the same vacuum source (shown in FIG. 10). If a common vacuum source is in fluid communication with the first and second ports, valves can be used in the fluid conduit between the ports and the vacuum source to enable the two ports to be used independently of each other.

Referring to FIG. 4, the liquid flow channel 24 is in fluid communication with the first port 34 through a gas flow duct drain 28. Islands 33 are formed in the liquid flow channel 24, creating flow channel segments 31 between the islands 33 to facilitate movement of the fluid toward the drain 28.

The liquid flow channel 24 is separated from the gas flow duct by a screen or porous member 30. The porous member 30 helps to ensure a consistent air flow rate across the width of the of the gas flow duct 22, so that it is not influenced by the varying depth of the liquid flow channels 24 that lie below the porous member 30. The perimeter of the porous member 30 is bonded to the upper surface of a recess in the upper face of the catcher. The bonding region 42 is shown in FIG. 4. The porous member 30 is supported by, but not bonded to the upper surfaces of the islands 33, allowing liquid to flow between the porous member and the upper surfaces of the islands. Preferably the porous member comprises a stainless steel Dutch Twill woven mesh with an effective pore size of 10 microns. Printing fluid drawn into the gas flow duct 22 can flow through the pores of the porous member 30 to enter the liquid flow channels 24 from which it can be extracted from the printhead.

It has been found that under certain operating conditions, printing fluid can enter the gas flow duct 22 at rates sufficiently low that the printing fluid can dry before it passes through the pores of the porous member and through the liquid flow channels 24 and exits through the drain 28. When this occurs, pores of the porous member or the flow channels can become clogged with dried printing fluid which prevents subsequent flow of printing fluid through the porous member into the duct drain.

Figure 5:
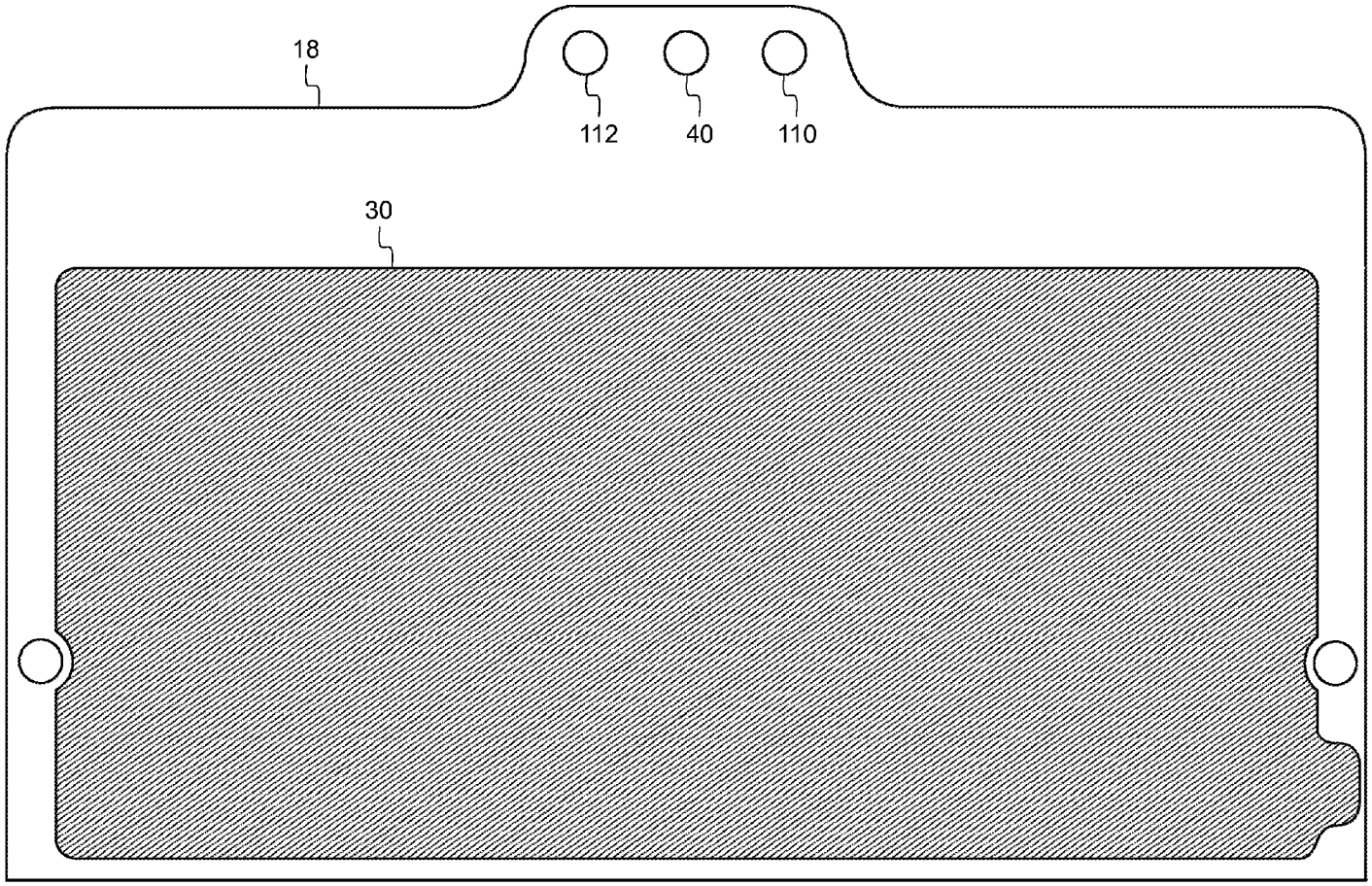
FIG. 5 is a top view of a catcher according to an embodiment of the invention showing a porous member for liquid extraction from the negative air duct.
Figure 6:
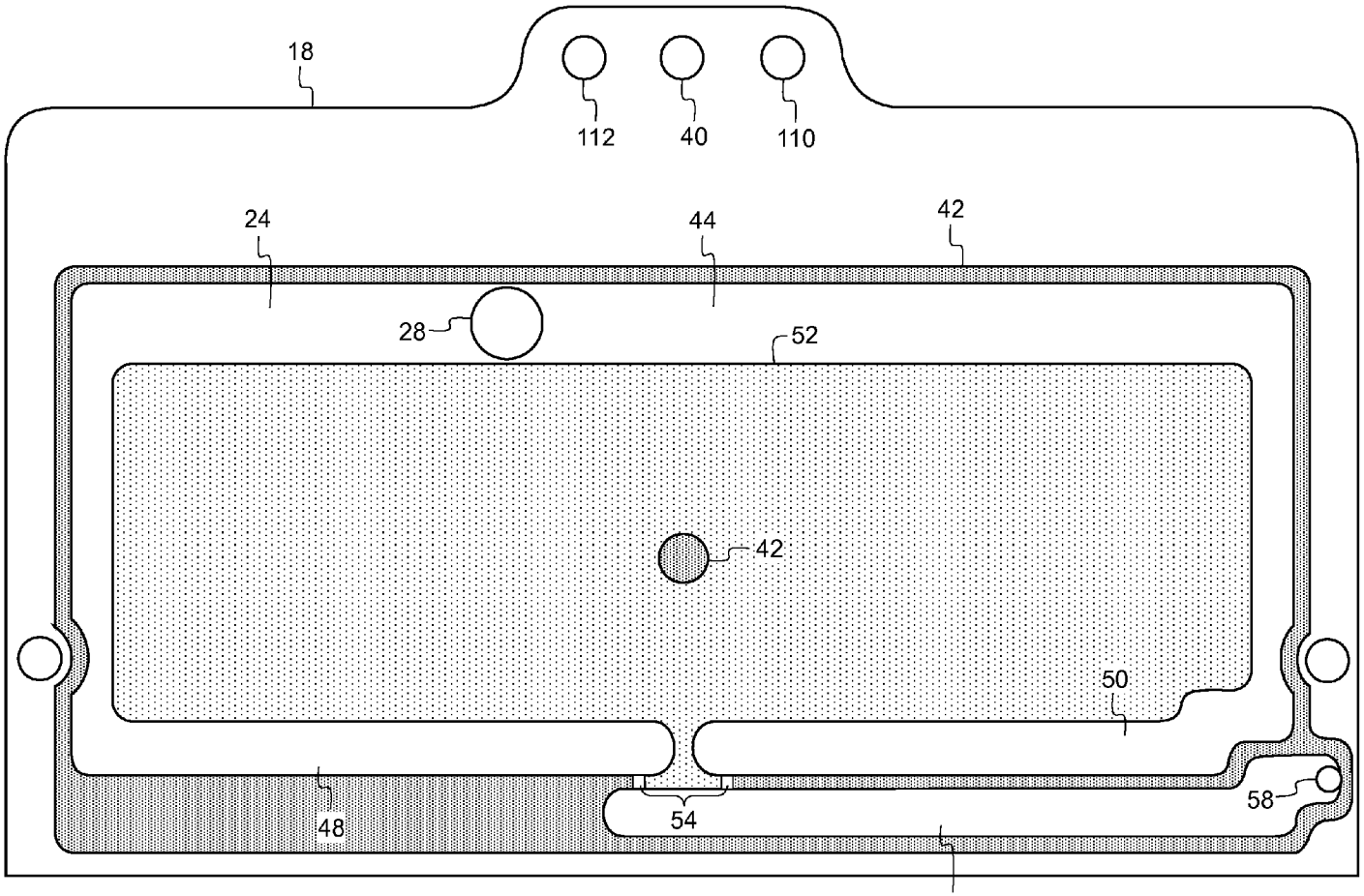
FIG. 6 is a top view of a catcher according to an embodiment of the invention showing the liquid flow channels below the porous member for liquid extraction.

To prevent printing fluid from drying in porous member 30 or the liquid flow channels, the invention provides an altered liquid flow channel geometry and means to introduce a flow of liquid through the liquid flow channels that contacts and wicks through the porous member such that the porous member and the flow channels remain moist. FIG. 5 shows a top view of the catcher with porous member 30, through which printing fluid, which enters the negative gas flow duct, can flow into the liquid flow channel 24 below the porous member. The altered liquid flow channel 24 under the porous member 30 is shown in FIGS. 6-9. The large first portion 44 of the liquid flow channel 24, substantially encircles a raised area, commonly referred to as a central island 52 with a first segment 48 wrapping around one side of the island 52 and a second segment wrapping around the second side of the island 52. The porous member 30 is supported but is not bonded to the raised area except for a small bonded spot near the center of the raised area (shown in FIG. 6), allowing printing fluid to flow through the pores of the porous member over the raised area 52 and then to flow laterally between the porous member 30 and the upper surface of the island to reach the liquid flow channel 24. The perimeter bonded region 42 of the porous member and the central bonded spot 56 keep the porous member in position.

A ScotchWeld™ epoxy is a useful adhesive for this purpose. The bonding adhesive in these regions fills the pores of the porous member in these regions preventing liquid from wicking through the porous member 30 or from flowing laterally between the porous member 30 and the bonding face of the catcher in these regions. The first portion of the liquid flow channel includes drain 28 through which liquid can be extracted from the liquid flow channel 24.

The liquid flow channel also includes a second portion 46 that is in fluid communication with the first portion 44 by means of one or more paths. The one or more paths typically comprise one or more restrictors 54. Alternatively the paths can comprise extended conduits. The second portion of the liquid flow channel includes a liquid supply inlet 58 through which liquid can be supplied to the second portion 46. Preferably two restrictors are used so that the second portion is individually coupled fluidically to the first segment of the first portion and to the second segment of the first portion. The independent fluid coupling by means of the two restrictors helps to ensure that liquid flows through both segments around the raised area 52 rather than all flow through a single segment. The restrictor portions 54 of the liquid flow channel 24 are shallower than the other portions of the flow channels, so that as the supplied liquid passes through the restrictors the liquid contacts and wicks into the porous member 30. Capillary forces cause the liquid to wick throughout the porous member covering the first portion 44 and the second portion 46 of the liquid flow channel 24 and the island 52. In this way, the supplied liquid is able to keep the porous member wet so that printing fluid can't dry in the pores of the porous member.

Figure 7:
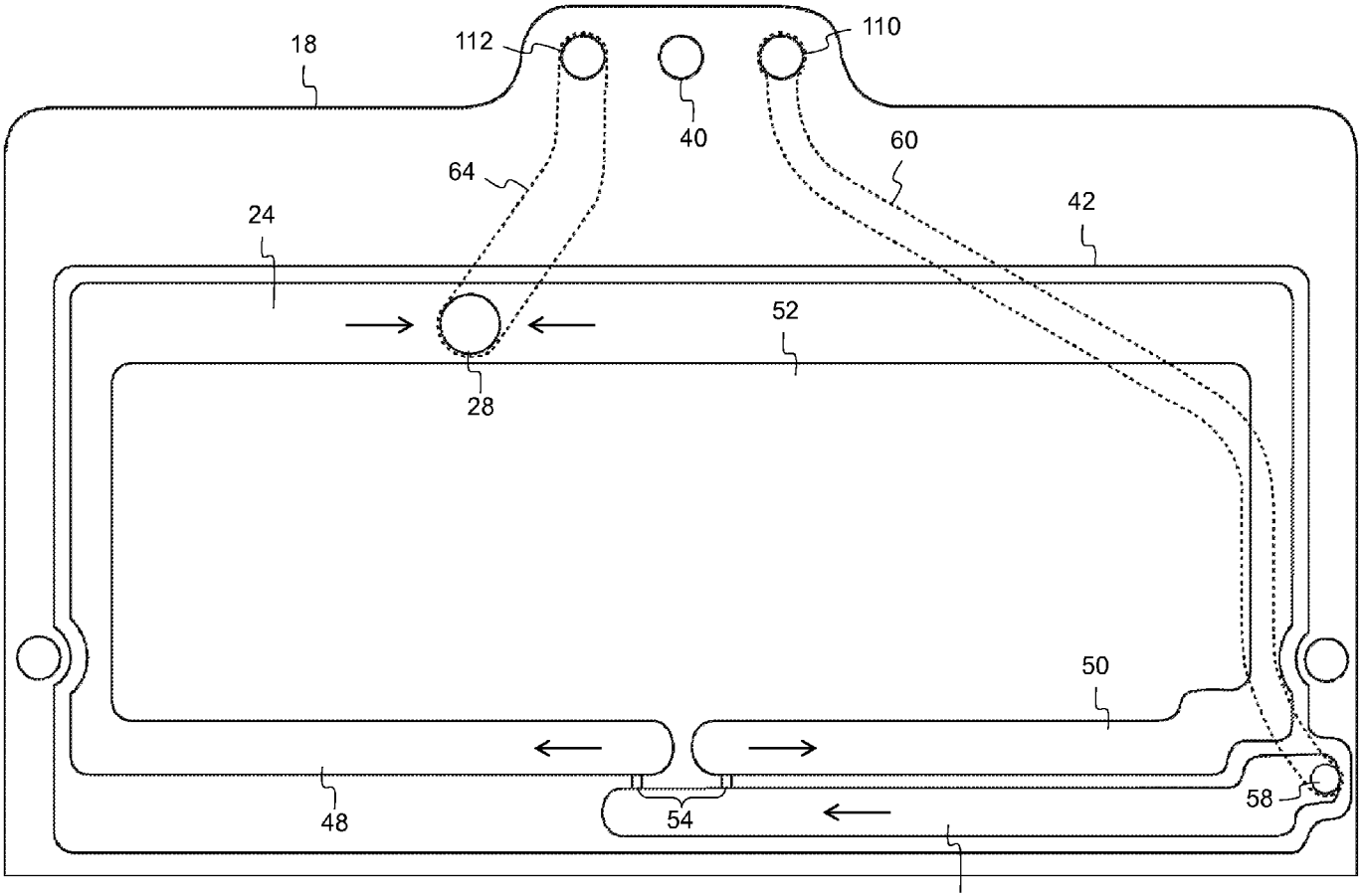
FIG. 7 is an illustration of a catcher according to an embodiment of the invention including the liquid flow channels below the porous member for liquid extraction and flow channels on the bottom of the catcher which provide fluid communication to liquid ports at the rear of the catcher.
Figure 8:
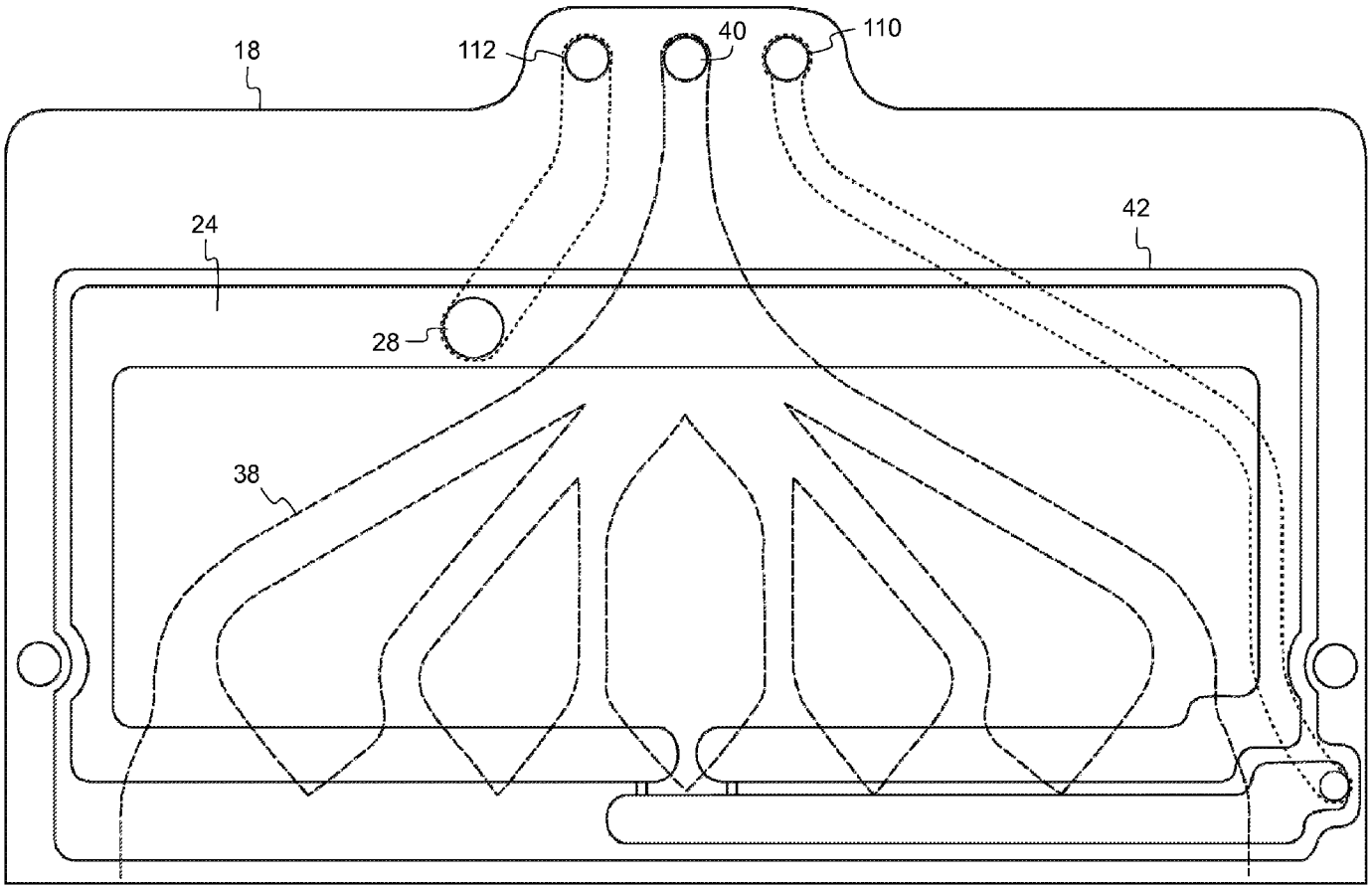
FIG. 8 is an illustration of a catcher according to an embodiment of the invention including the liquid flow channels below the porous member for liquid extraction and flow channels on the bottom of the catcher which provide fluid communication to liquid ports at the rear of the catcher, and also includes the catcher return channels that are typically formed into the catcher plate attached to the bottom of the catcher.
Figure 9:
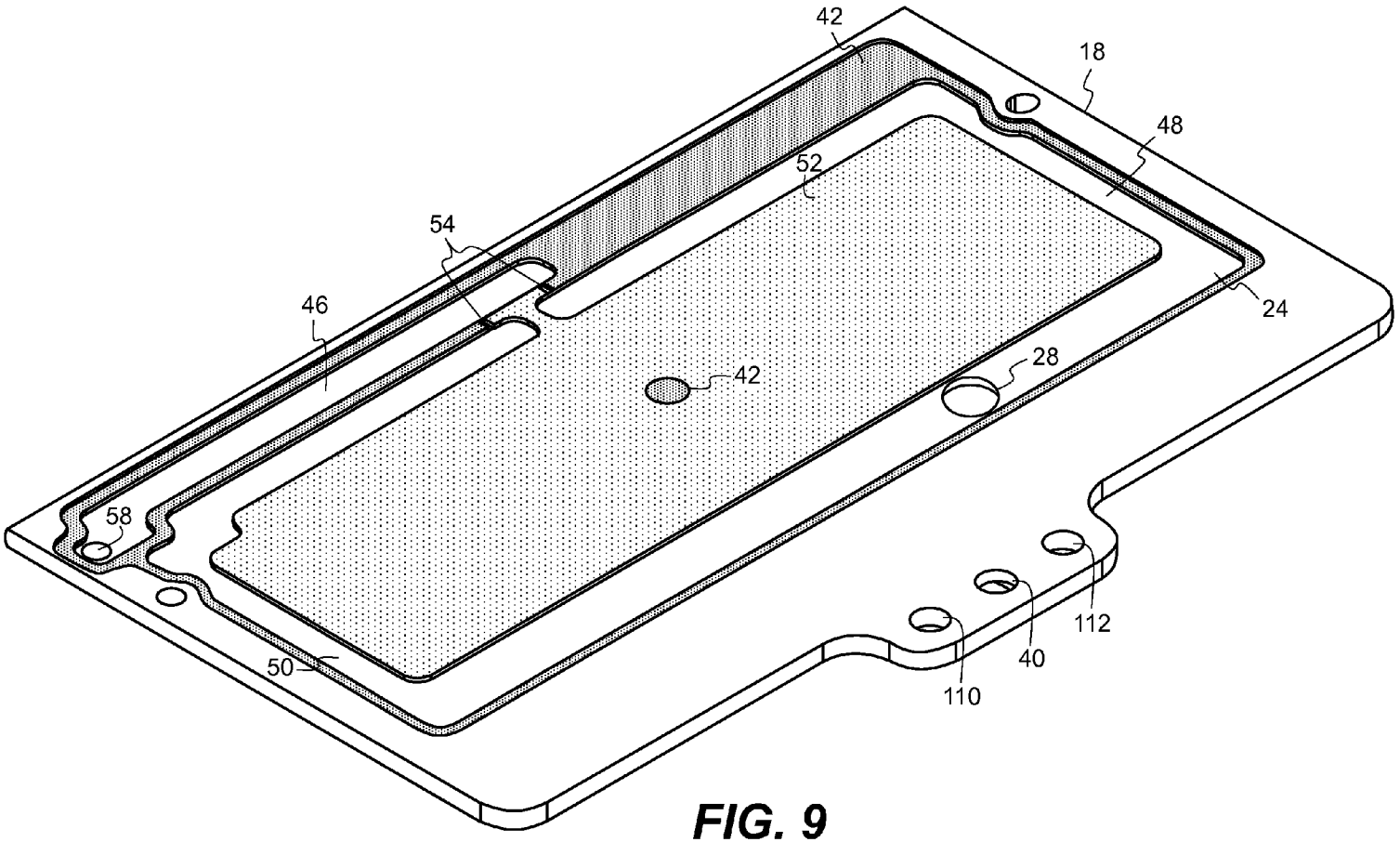
FIG. 9 is an isometric view of a catcher according to an embodiment of the invention, showing the liquid flow channels below the porous member for liquid extraction.

FIG. 7 shows the flow path of the supplied fluid through the liquid flow channel 24. The liquid from the fluid system is supplied through supply port 110, and flows through the supply channel that is formed on the bottom side of the catcher 18. From the supply channel the liquid passes through the supply inlet 58 to enter the second portion 46 of the liquid flow channel 24. The liquid then flows through the restrictors 54 to enter the first and second segments 48 and 50, respectively, of the first portion 44 of the liquid flow channel. Some of the liquid flows around the island 52 via the first segment 48 and some liquid flows around the other side of the island via the second segment of the first portion 44 of the liquid flow channel. The two restrictors 54 that separate the first portion of the liquid channel from the second portion help to ensure that liquid flow is split, passing around each side of the island 52 rather than all going around one side of the island. The liquid flows converge on the drain 28, which connects the liquid flow channel 24 with the drain channel 64 that is formed on the bottom of the catcher. Liquid is extracted from the drain channel through the drain port 112 and returned to the fluid system, described later. In addition to the features shown in FIG. 7, FIG. 8 shows the catcher flow channels 38 that return printing fluid from the non-print drops to the fluid system. FIG. 9 shows another perspective view of the catcher, with the porous member not shown, to show the liquid flow channel 24.

FIG. 10 shows an exemplary fluid system that can be employed with this invention to drain fluid from the gas flow duct and also for the process of cleaning the gas flow duct. Fluid system 71 has an ink reservoir 72 from which printing fluid is pumped to the jetting module 12 through filter 76 by ink pump 74. To aid in flushing contaminates from the jetting module 12, printing fluid can be cross flushed through the jetting module and returned to the ink reservoir via waste valve 134 when the cross flush valve 78 is open. A vacuum on the ink reservoir provided by vacuum pump 80 aids in returning the printing fluid to the ink reservoir 72. Printing fluid jetted from the jetting module 12 that is collected by catcher 18 is removed from the catcher through catcher port 40 (second port) through an open catcher valve 82 and is returned to the ink reservoir 72 via catcher waste valve 84. The vacuum on the ink reservoir 72 aids in the return of this printing fluid as well.

The ink drops produced by the jetting module are deflected by the lateral flow of gas across the drop trajectories produced by gas source 15 directing gas through the positive gas flow duct 14 toward the drop trajectories and by suction into the negative gas flow duct 16 provided by the vacuum source 17. Printing fluid entering the negative air duct can be removed from the duct through the drain port 112, also called the first port. This printing fluid is removed from the drain port 112 through open valve 86 and is directed to the ink reservoir 72 through return select valve 88 as a result of vacuum on the ink reservoir provided by vacuum pump 80. A flow restrictor 89 may be used in the fluid line from the first port to limit the amount of air drawing into the liquid flow channel. Valves 84 and 88 can activated to divert fluid that is normally returned to the ink reservoir 72 from the drain port 112 and the catcher return into a waste tank. This enables highly contaminated printing fluid to be directed to the waste tank 98 rather than mixing with the printing fluid in the ink reservoir 72.

To keep the printing fluid from drying in the porous member that separates the gas flow duct from the liquid channel, liquid supply valve 106 is opened to allow pressurized printing fluid from the ink pump to flow through the supply port 110, also called the second port, into the liquid flow channel of the negative gas flow duct. A restrictor 100 may be used to limit the flow rate of printing fluid to the supply port 110. Preferably the restrictor 100 is located downstream of the liquid supply valve 90; as it has been found that with the restrictor positioned upstream of the liquid supply valve 90, transient pressure surges can occur when valve 90 is opened that cause ink to flow through the pores of the porous member into the negative gas flow duct. The printing fluid passes through the two restrictors that separate the second portion of the liquid flow channel from the first portion of the liquid flow channel. The printing fluid flows through the two segments of the liquid flow channel that surround the island and is extracted through the drain port 112.

Liquids distinct from the printing fluid can alternatively be made to through the liquid flow channels of the negative gas flow duct. In a preferred embodiment, the liquid comprises a replenishment fluid used by the fluid system to make up for evaporation of the carrier liquid from the printing fluid. Typically the replenishment fluid includes only components of the printing fluid such as the carrier solvent such as water of the printing fluid, along with other volatile components of the printing fluid, but it doesn't include the colorants, dyes or pigments, or other non-volatile components of the printing fluid. Replenishment fluid from the replenishment tank 92 is pumped by pump 94 through filter 96, valve 90, and restrictor 100 to the supply port 110 of the liquid flow channel. The flow of liquid extracted from the drain port is controlled by valve 86 and return select valve 88. As a continuous flow of replenishment fluid through the liquid flow channels 24 and on to the ink reservoir could cause the concentration of the printing fluid in the ink reservoir to drop, the system controller 9 (FIG. 1) can control whether to flow printing fluid or replenishment fluid to the supply port 110 based on the ink level in the ink reservoir 72 measured by level sensor 104 and on the printing fluid concentration measured by concentration sensor 102. Typically the liquid flow is primarily of printing fluid, supplied by ink pump 74 that passes through ink supply valve 106 and restrictor 100 to the supply port 110. The controller 9 (FIG. 1) can based on the output of the level sensor 104 and the concentration sensor 102, close valve 106, energize the pump 94 and open valve 90 to cause replenishment fluid to be delivered to the supply port 110. This delivered replenishment fluid passes through the liquid flow channels 24, the drain port 112, and valves 86 and 88 to the ink reservoir 72 to help restore the printing fluid concentration to the desired value. When either the desired amount of replenishment fluid has been directed to the ink reservoir vie the liquid flow channel 24, or the printing fluid concentration has been restored to the desired level, then the controller closes valve 90, de-energizes the pump 94 and opens valve 106 to again cause printing fluid to flow through the liquid supply channels.

When the printhead is being shut down or during special cleaning steps, the controller can activate pump 128 and valve 116 to supply a cleaning fluid from cleaning fluid supply 118 to the supply port 110 to more effectively clean printing fluid residue from the duct and the screen. The cleaning fluid is extracted through drain port 112 and is typically directed through valve 86 and return select valve 88 to the waste tank 98 to prevent the cleaning fluid from contaminating the printing fluid in the ink reservoir 72 The cleaning fluid is distinct from the printing fluid and typically can include more or more solvents or cleaning agents which are not included in the printing fluid or replenishment fluid to dissolve and remove dried printing fluid residues and it excludes the colorants or other non-volatile components of the printing fluid.

In some embodiments, a fluid is supplied to the liquid flow channels 24 the entire time that printing fluid is jetted from the printhead nozzles 20 and there is a flow of gas through the negative gas flow duct 16. In other embodiments, fluid is intermittently supplied to the liquid flow channels 24. In some embodiments the flow of replenishment fluid is controlled by controlling the activation level of pump 94 or pump 128 without the need for liquid supply valve 90 or cleaning fluid valve 116, respectively.

The invention has been described in detail with particular reference to certain preferred embodiments thereof, but it will be understood that variations and modifications can be effected within the spirit and scope of the invention.

PARTS LIST

9 Controller
10 Printhead
11 gas flow source
12 Jetting module
13 Gas flow
14 Positive gas flow duct
15 Blower
16 Negative gas flow duct
17 Vacuum source
18 Catcher
19 Ink puddle
20 Nozzle
21 Drop deflection zone
22 Gas flow duct
23 Drop Trajectories
24 Liquid flow channel
25 Upper wall
26 Wall
27 Lower wall
28 Drain
29 Lower wall
30 Porous member
31 Segment
33 Island
34 Drain port
36 Drain channel
38 Catcher flow channel
39 Catcher plate
40 Second port
42 Bonding region
44 First portion
46 Second portion
48 First segment
50 Second segment
52 Island
54 Restrictor
56 Bonded spot
58 Supply inlet
60 Supply channel
62 Gas flow
64 Drain channel
72 Ink reservoir
74 Ink pump
76 Filter
78 Cross flush valve
80 Vacuum pump
82 Catcher valve
84 Catcher waste valve
86 Valve
88 Return select valve
89 Flow restrictor
90 Liquid supply valve
92 Replenishment supply
94 Pump
96 Filter
98 Waste tank
100 Restrictor
102 Concentration sensor
104 Level sensor
106 Ink Supply Valve
108 Replenishment valve
110 Supply port
112 Drain port
114 Cleaning fluid valve
116 Cleaning fluid valve
118 Cleaning fluid supply
120 Filter
122 Filter
124 Filter
126 Refill valve
128 Ink supply
130 Pump
132 Filter
134 Waste valve

The invention claimed is:

1. A continuous printhead drop deflector system comprising:

a gas flow duct including a wall, the wall including a porous member having pores through which liquid can flow;

a liquid flow channel, the flow channel being separated from the gas flow duct by the porous member, the flow channel comprises;

a) a first port for extracting liquid from a first portion of the liquid flow channel;

b) a second port for supplying liquid to a second portion of the liquid flow channel;

c) one or more paths in the liquid channel permitting fluid to flow from the second portion to the first portion;

wherein liquid, supplied through the second port to the second portion of the liquid channel and through the one or more paths to the first portion of the liquid channel, contacts and wicks into the porous member before being extracted through the first port.

2. The continuous printhead drop deflector system of claim 1, wherein the fluid supplied to the liquid flow channel is a fluid distinct from a fluid used in the printhead for printing onto a receiver medium.

3. The continuous printhead drop deflector system of claim 2, wherein the fluid supplied to the liquid flow channel is a cleaning fluid, containing components not included in the printing fluid, used to remove printing fluid residues printing fluid from the porous member.

4. The continuous printhead drop deflector system of claim 1, wherein fluid is supplied to the liquid flow channel intermittently during times when printing fluid is jetted by the printhead and a gas is flowing in the gas flow duct.

5. The continuous printhead drop deflector of claim 1 wherein the first portion surrounds at least a portion of a raised area which supports the porous member.

6. The continuous printhead drop deflector of claim 1 wherein the one or more paths includes one or more restrictors that direct the flow of liquid from the second portion of the liquid channel through specific regions of the liquid channel.

7. The continuous printhead drop deflector of claim 1 wherein the liquid extracted from the first port is returned to a fluid reservoir.

8. The continuous printhead drop deflector 1 wherein the liquid extracted from the first port is discarded.

* * * * *